US008939303B2

(12) United States Patent
Sibbett

(10) Patent No.: US 8,939,303 B2
(45) Date of Patent: Jan. 27, 2015

(54) KNOCK DOWN WOOD BOX SYSTEM

(71) Applicant: Peter Y Sibbett, Tacoma, WA (US)

(72) Inventor: Peter Y Sibbett, Tacoma, WA (US)

( * ) Notice: Subject to any disclaimer, the term of this patent is extended or adjusted under 35 U.S.C. 154(b) by 0 days.

(21) Appl. No.: 14/106,958

(22) Filed: Dec. 16, 2013

(65) Prior Publication Data

US 2014/0166619 A1 Jun. 19, 2014

Related U.S. Application Data

(60) Provisional application No. 61/737,631, filed on Dec. 14, 2012.

(51) Int. Cl.
*B65D 6/16* (2006.01)

(52) U.S. Cl.
CPC ..... *B65D 9/12* (2013.01)
USPC ..... 217/12 R; 217/65; 220/666

(58) Field of Classification Search
CPC ..... B65D 9/12
USPC ..... 217/12 R, 65; 220/666
See application file for complete search history.

(56) References Cited

U.S. PATENT DOCUMENTS 2,636,229 A * 4/1953 Anderson ..... 403/22

* cited by examiner

*Primary Examiner* — Elizabeth Volz

(57) ABSTRACT

A knock down wood box system is a storage container system that is provided with an initial easily transportable disassembled configuration that is constructed into a sturdy assembled configuration without tools or adhesives. The knock down wood box system creates an enclosable storage compartment that can be collapsed when not in use such that it inhabits a much smaller amount of space. The knock down wood box system accomplishes this through the use of a plurality of panel sections that are particularly arranged to a plurality corner clips. The knock down wood box system in the assembled configuration may also serve as a decorative piece. Resultantly, it is also an object of the knock down wood box system to create a box that is aesthetically pleasing to the user.

11 Claims, 9 Drawing Sheets

KNOCK DOWN WOOD BOX SYSTEM

The current application claims a priority to the U.S. Provisional Patent application Ser. No. 61/737,631 filed on Dec. 14, 2012. The current application is filed on Dec. 16, 2013, while Dec. 14, 2013 was on a weekend.

FIELD OF THE INVENTION

The present invention relates generally to wooden boxes. More specifically, the present invention is a wooden box that can be assembled, disassembled, and reassembled all without the use of tools or adhesives. This type of box is more commonly known as a knock down box for its ability to be "knocked down" quickly and easily.

BACKGROUND OF THE INVENTION

Throughout history, humans have always sought to collect material possessions. These material possessions may serve as anything from frivolous statements of wealth to objects of sentimental value, to tools which perform a specific and valued function. Whatever the type of object, there is one issue in particular that is associated with any object or collection of objects; storage. Objects could simply be tossed about in the user's living space, however this does not facilitate a clean living space and can make it quite difficult to find those objects when the user wishes to use them; something that is especially true of tools. Also, there are sometimes certain sets of objects which the user may wish to keep together as they form a complete set. The issues represent the storage needs experience by almost all people who have even a small number of material possessions. To solve these storage issues, humans have developed and used a myriad of different storage containers ranging from boxes to bins to huge shipping crates. The box is perhaps the most common of all storage methods when it comes to public use. As such, there are many different forms of boxes as well as many different materials that the boxes are comprised of. The construction of boxes varies wildly from those that are constructed of injection molded plastic to those constructed of panels of wood fastened together. One issue in particular exists with regards to such boxes; they take up the same amount of space when they are empty as they do when they are full.

It is therefore the object of the present invention to provide a knock down wood box system that is provided in an initial configuration that is well suited for transportation and can be constructed to create a storage compartment without the use of tools or adhesives. The knock down wood box system creates an enclosable storage compartment that can be collapsed when not in use such that it inhabits a much smaller amount of space. The knock down wood box system accomplishes this through the use of a plurality of panel sections that are particularly arranged to a plurality corner clips. The knock down wood box system may also serve as a decorative piece in its assembled configuration. Resultantly, it is also an object of the knock down wood box system to create a box that is aesthetically pleasing to the user.

BRIEF DESCRIPTIONS OF THE DRAWINGS

DETAIL DESCRIPTIONS OF THE INVENTION

All illustrations of the drawings are for the purpose of describing selected versions of the present invention and are not intended to limit the scope of the present invention.

Figure 1:
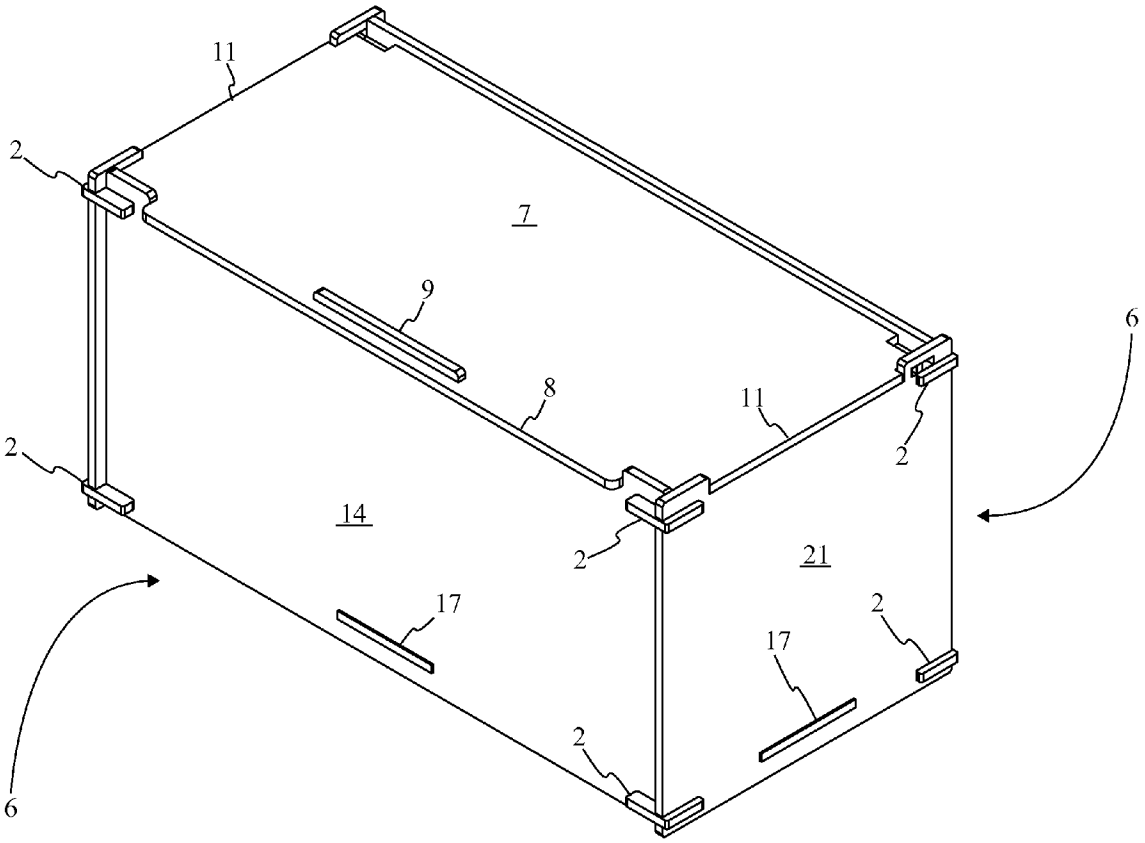
FIG. 1 is a perspective view displaying knock down wood box system in its assembled configuration with the upper panel positioned in the closed configuration.
Figure 2:
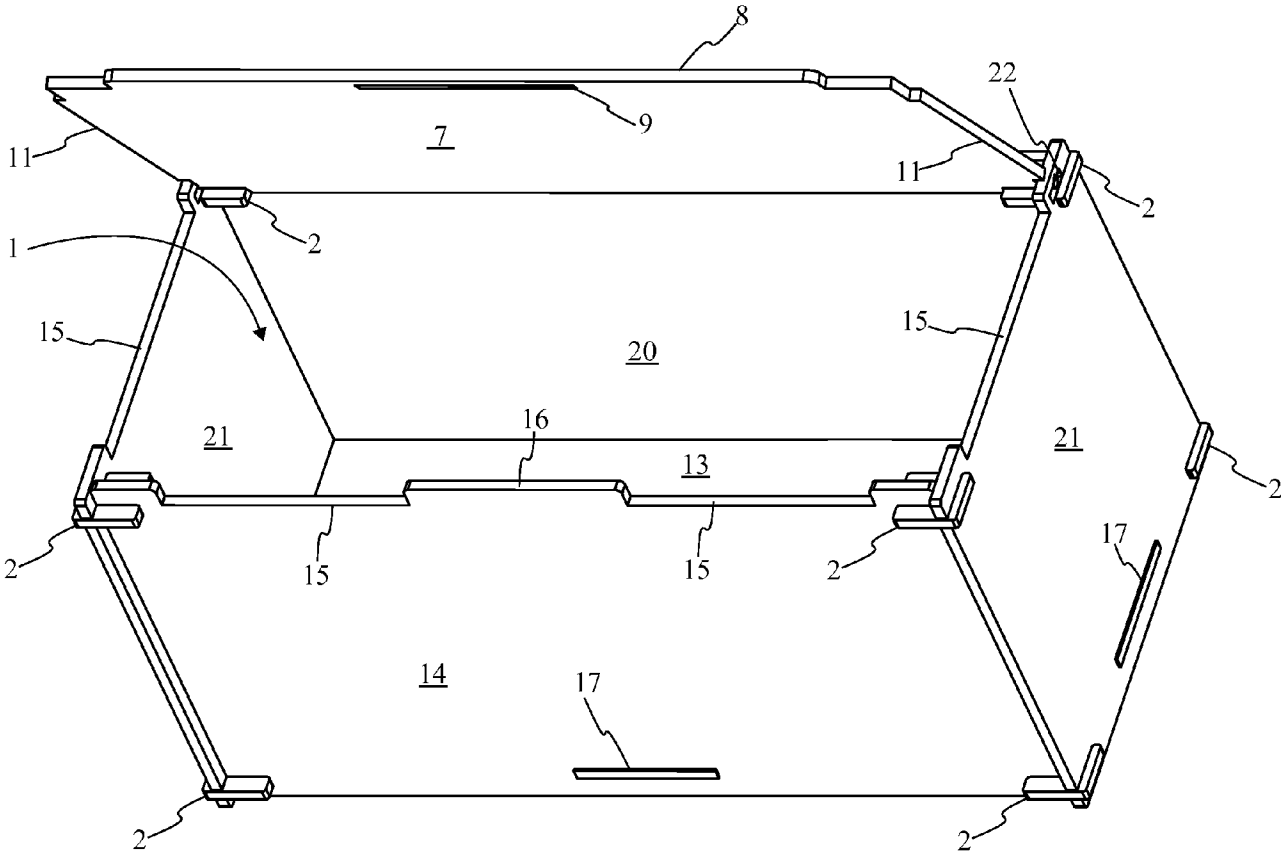
FIG. 2 is a perspective view displaying knock down wood box system in its assembled configuration with the upper panel positioned in the open configuration.
Figure 3:
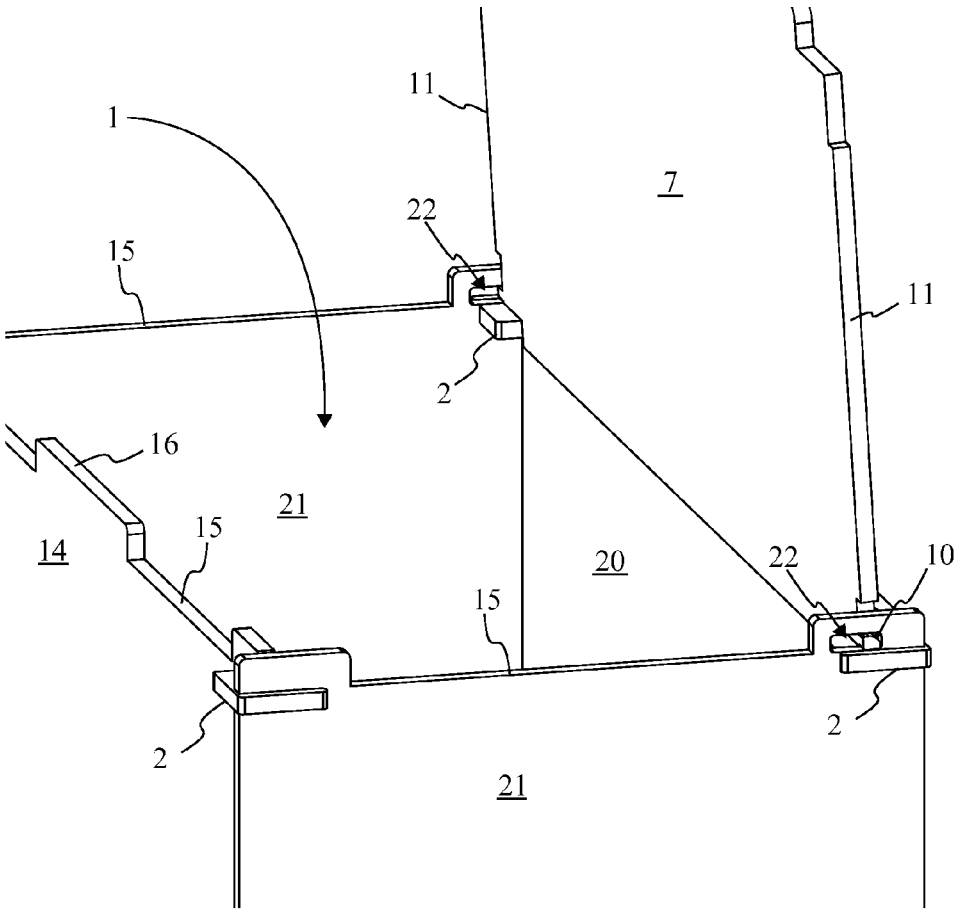
FIG. 3 is an enhanced perspective view displaying the positioning of the axle members within the axle mount in the open configuration.
Figure 4:
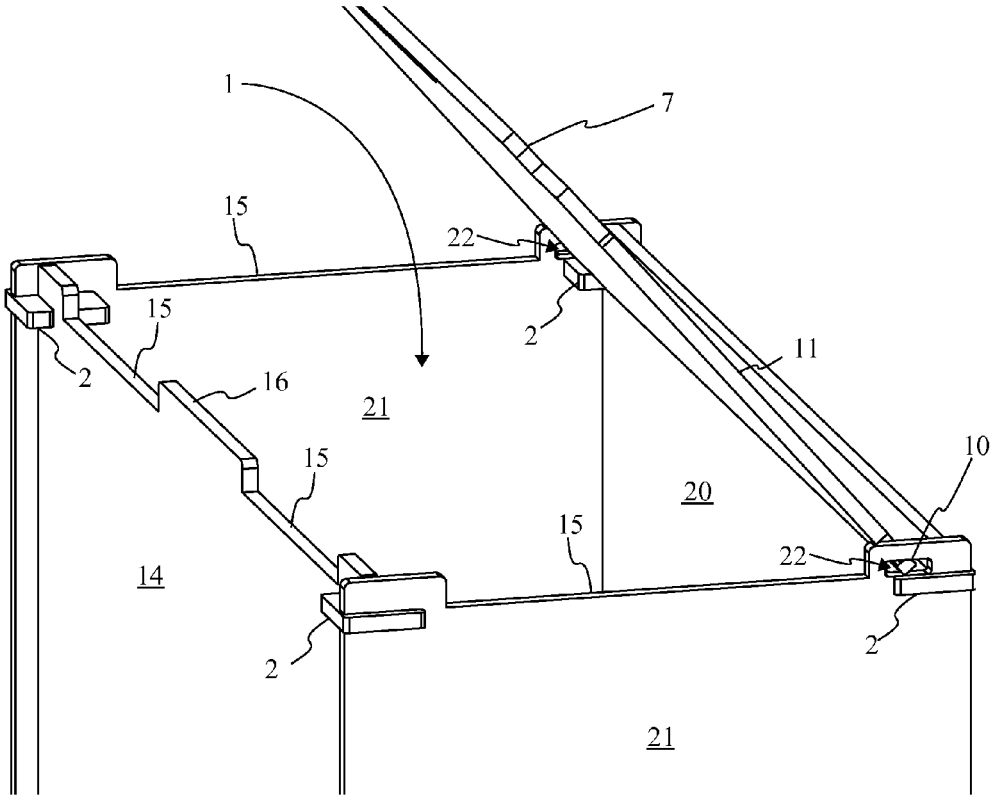
FIG. 4 is an enhanced perspective view displaying the positioning of the axle members within the axle mount while transitioning between the open configuration and the closed configuration.
Figure 6:
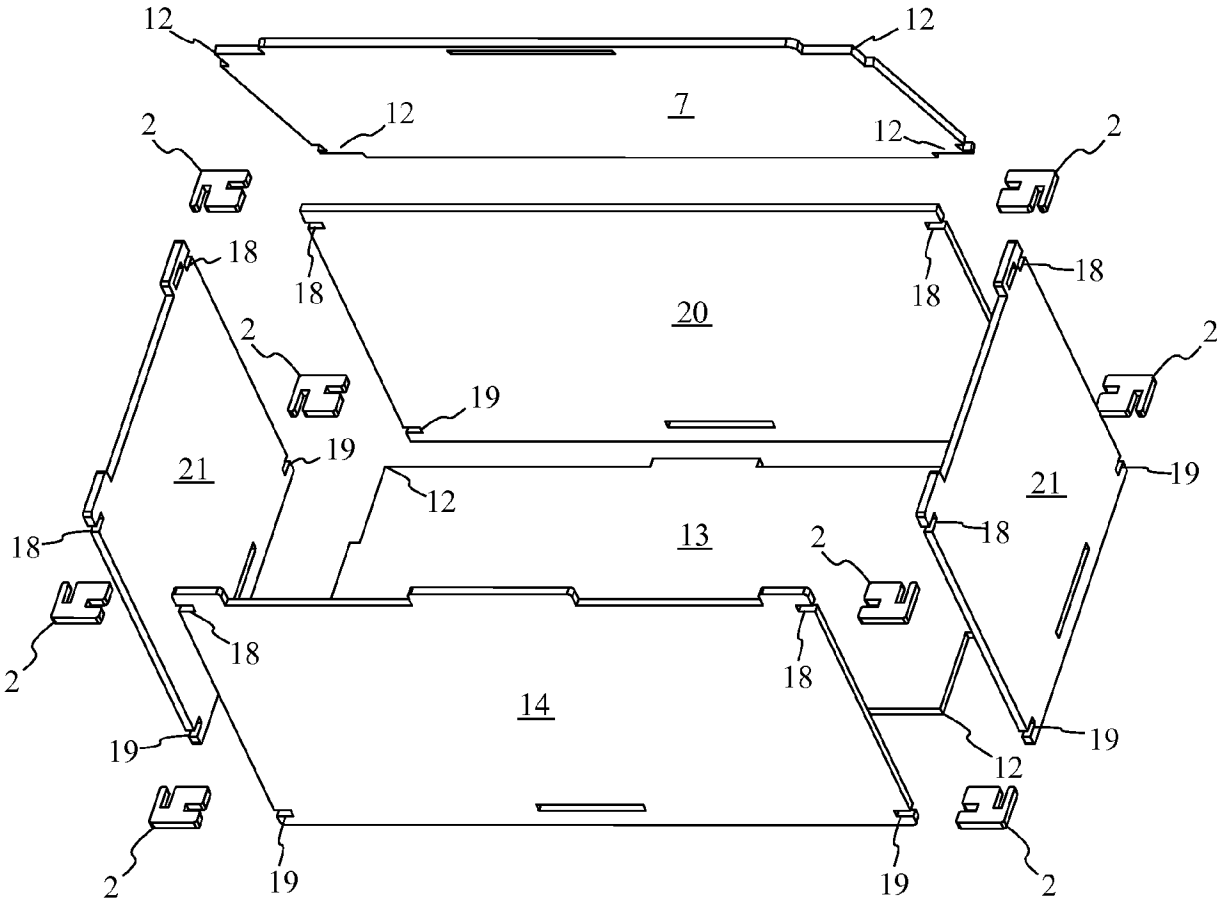
FIG. 6 is an expanded perspective view displaying the relative positioning between the plurality of panel section and the plurality of corner clips as per the current embodiment of the present invention.

Referencing FIG. 1, FIG. 2, and FIG. 6, the knock down wood box system is a storage container system that is provided with an initial easily transportable disassembled configuration that is constructed into a sturdy assembled configuration without tools or adhesives. The present invention comprises a plurality of panel sections 6 and a plurality of corner clips 2. The plurality of panel sections 6 are particularly formed panels that permit a plurality of compact arrangements in a disassembled configuration that facilitate transportation. The plurality of corner clips 2 function as specially formed couplers that engage the plurality of panel sections 6 in a particular arrangement that secures the assembled configuration without the use of tools or adhesives. The plurality of panel sections 6 and the plurality of corner clips 2 function complimentarily through their particular arrangement and form an enclosable storage compartment 1.

Figure 5:
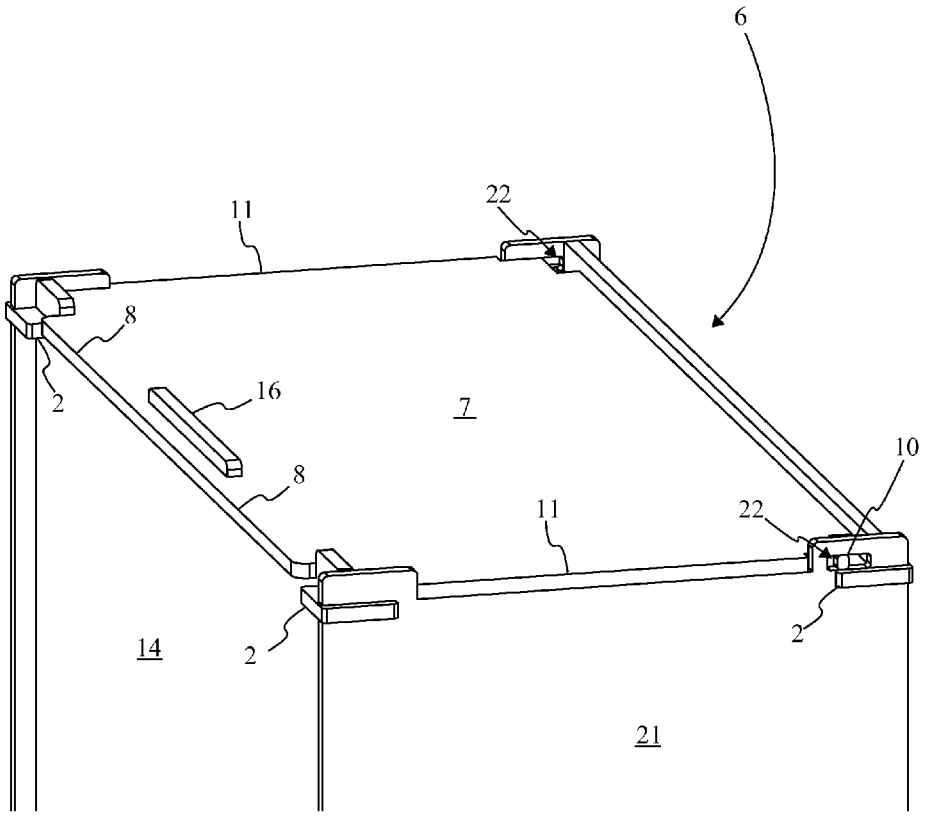
FIG. 5 is an enhanced perspective view displaying the positioning of the axle members within the axle mount in the closed configuration.

Referencing FIG. 5, and FIG. 6, the plurality of panel sections 6 function as the main structural components that provide the body of the knock down wood box. The plurality of panel sections 6 are coupled with the plurality of corner clips 2 through complimentary engagement channels. The complimentary engagement channels require the proper alignment of each panel section of the plurality of panel sections 6 as well as the proper orientation and alignment of each corner clip of the plurality of corner clips 2 in order to securely form the assembled configuration. In the assembled configuration, the plurality of panel sections 6 form an interior chamber that functions as an enclosable storage compartment 1. The enclosable storage compartment 1 is an accessible chamber within the knock down wood box that is surrounded by the plurality of panel sections 6. The plurality of panel sections 6 comprise an upper panel 7, a base panel 13, a front panel 14, a rear panel 20, and a pair of lateral panels 21. The upper panel 7 functions as a lid that provides access to the enclosable storage compartment 1. The base panel 13 is positioned opposite the upper panel 7 and functions as the floor of the enclosed storage compartment. The front panel 14, the rear panel 20, and the pair of lateral panels 21 are perpendicularly arranged and function as the lateral surfaces of the knock down wood box. It should be noted that the plurality of panel section are provided with equal thickness, wherein the thickness of each panel section is defined as the distance between oppositely positioned face sides. The uniformity of the thickness is provided as a means of ensuring proper engagement with the plurality of corner clips 2. It should be noted that the upper panel 7 and the base panel 13 can have differing thicknesses since they are not coupled by the plurality of corner clips 2.

Referencing FIG. 3-6, the upper panel 7 functions as a pivotably engaged panel section that permits access to the enclosable storage compartment 1. The upper panel 7 is found pivotably coupled to the pair of lateral panels 21. The pivotable coupling provides the upper panel 7 with the ability to pivot between a closed configuration and an open configuration, where the closed configuration has the upper panel 7 perpendicular with the front panel 14, the rear panel 20, and the pair of lateral panels 21 covering the enclosable storage compartment 1 while the open configuration has the upper panel 7 rotated into an angular position, relative to the pair of lateral panels 21, that permits access to the enclosable storage compartment 1. In the current embodiment of the present invention, the upper panel 7 comprises a front panel mount 8, a pair of axle members 10, a pair of lateral panel mounts 11, and a set of corner engagements 12. The front panel mount 8 is a structural feature that is particularly designed to engage a complementary region of the front panel 14. The pair of axle members 10 are oppositely positioned features that when engaged by the pair of lateral panels 21 permit the rotation of the upper panel 7 about their central axis. The pair of lateral panel mounts 11 are oppositely positioned structural features that are rotatably coincident to complimentary regions of the pair of lateral panels 21. The set of corner engagements 12 of the upper panel 7 are specific regions of the upper panel 7 that become coincident with the plurality of corner clips 2 in the closed configuration. The set of corner engagements 12 function as a means of distributing weight to the corner clips 2 if needed.

Referencing FIG. 2-5, the front panel mount 8 of the upper panel 7 engages the front panel 14 in the closed configuration and can additionally function as a means of locking the upper panel 7 in the closed configuration. In the current embodiment of the present invention, the front panel mount 8 comprises a front panel coupler 9. The front panel coupler 9 is a structural element that permits the secure engagement of the front panel mount 8 to the complimentary region of the front panel 14. In the current embodiment, the front panel 14 comprises an upper panel mount 15 that serves as the complimentary region that engages the front panel mount 8. The upper panel mount 15 merely retains the front panel mount 8 in the closed configuration. The upper panel mount 15 utilizes an upper panel coupler 16 as the means of creating a secure engagement with the front panel coupler 9. The front panel coupler 9 and the upper panel coupler 16 are detachably engaged but provide the necessary features to permit the addition of a locking mechanism.

Referencing FIG. 3-6, the front panel 14 is the forward facing panel section that detachably engages upper panel 7. The front panel 14 is perpendicularly coupled to the pair of lateral panels 21 by way of the plurality of corner clips 2. The front panel 14 is found positioned opposite the location of rear panel 20. The front panel 14 is found parallel to the rear panel 20. In the current embodiment of the present invention, the front panel 14 comprises an upper panel mount 15, a base panel mount 17, upper channels 18, and lower channels 19. The upper panel mount 15 functions as a complimentary engagement region with the front panel 14 that detachably engages the front panel mount 8. The base panel mount 17 is a structural feature that engages the base panel 13 securing its positioning near the lower channels 19. The lower channels 19 are found positioned opposite the upper channels 18 and function as engageable feature for the plurality of corner clips 2. The upper channels 18 are found positioned adjacent to the upper panel 7 and function as engageable features for the plurality of corner clips 2. Through the engagements with the plurality of corner clips 2, the lower channels 19 and the upper channels 18 of the front panel 14 allow the front panel 14 to securely engage the pair of lateral panels 21 opposite the rear panel 20.

Figure 8:
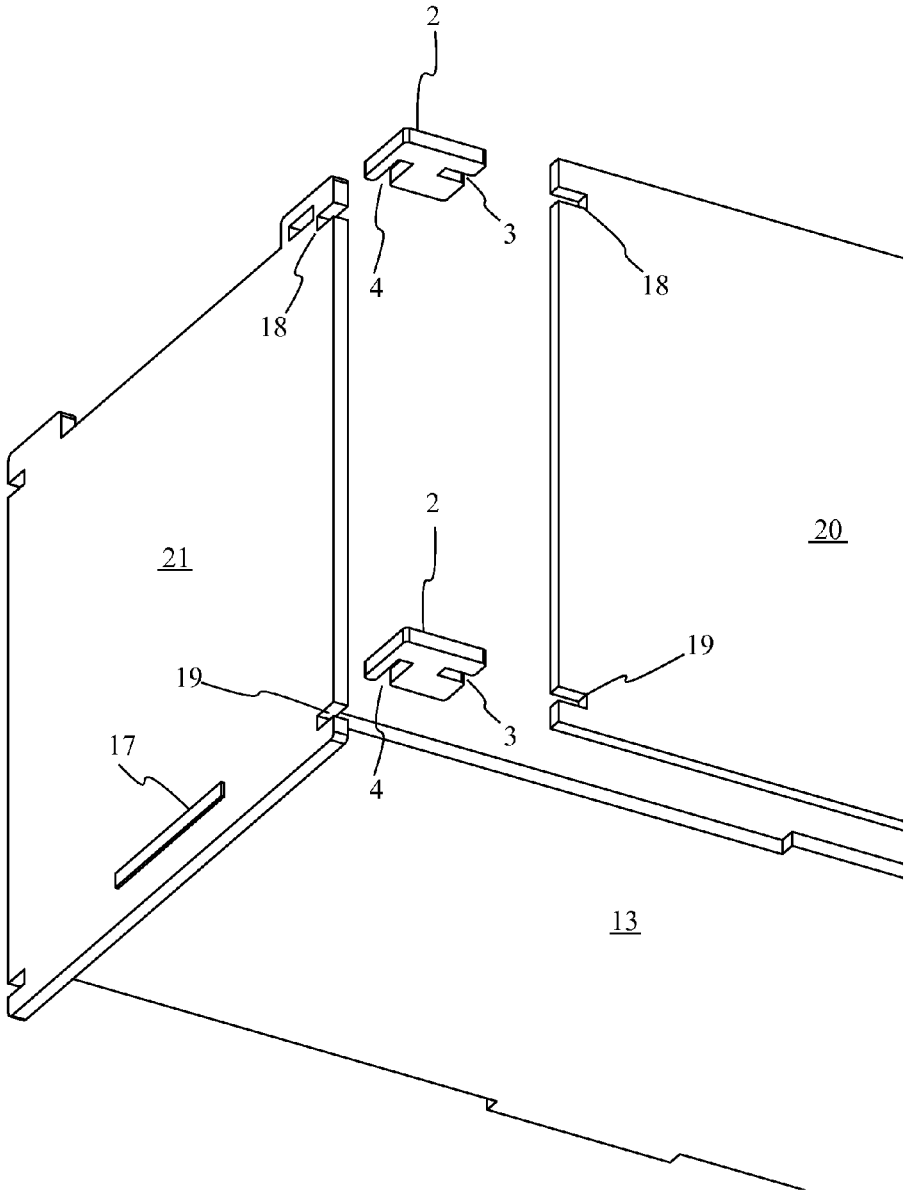
FIG. 8 is an enhanced perspective view displaying the orientation of the plurality of corner clips with the plurality of panel sections prior to engagement.
Figure 9:
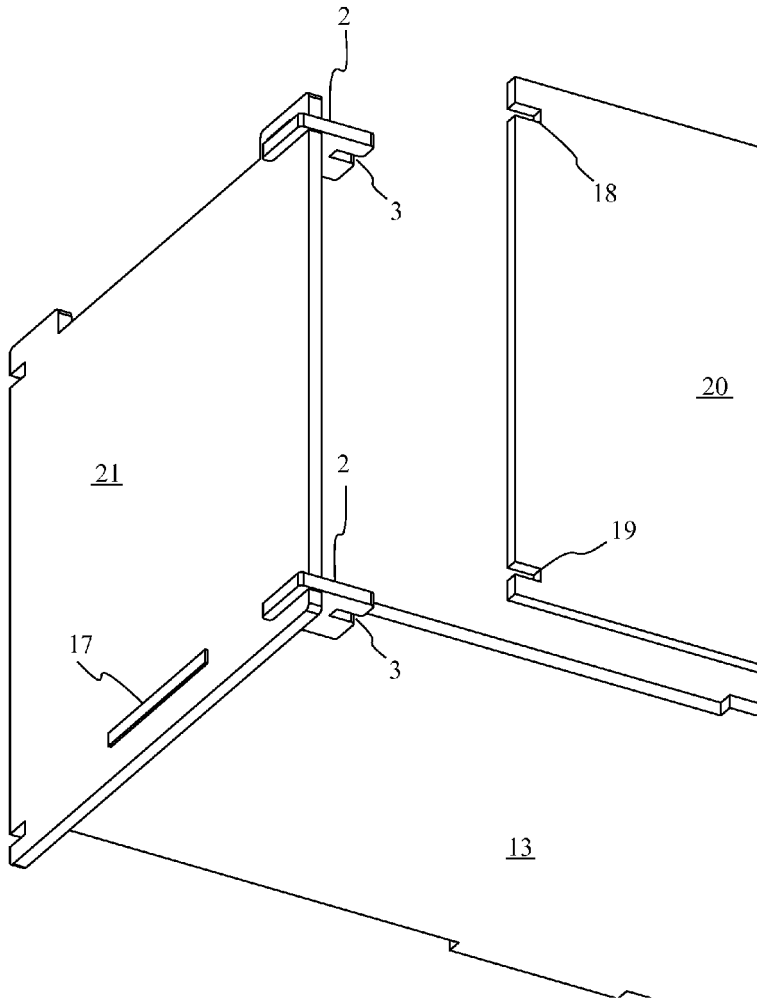
FIG. 9 is an enhanced perspective view displaying the partial engagement between the plurality of corner clips and the plurality of panel sections.

Referencing FIG. 6, FIG. 8, and FIG. 9, the rear panel 20 is the oppositely positioned to the front panel 14. The rear panel 20 is coupled to the pair of lateral panels 21 by way of the plurality of corner clips 2. In the current embodiment of the present invention, the rear panel 20 comprises a base panel mount 17, upper channels 18, and lower channels 19. The base panel mount 17 of the rear panel 20 is found positioned coplanar with the base panel mount 17 of the front panel 14 provides a means of securely engaging the base panel 13. The upper channels 18 and the lower channels 19 of the rear panel 20 function as a means of engaging the plurality of corner clips 2. The plurality of corner clips 2 coincident with the upper channels 18 and lower channels 19 of the rear panel 20 perpendicularly engage the pair of lateral panel 21.

Referencing FIG. 1-6, the pair of lateral panels 21 are positioned symmetrically across an imaginary lateral line that traverses normal to the front panel 14 and the rear panel 20. The pair of lateral panels 21 are perpendicularly coupled to the front panel 14 and the rear panel 20 by way of the plurality of corner clips 2. The upper panel 7 is mounted to the pair of lateral panels 21 with a pivotable and moveable engagement permitting the upper panel 7 to transition between the open configuration and the closed configuration. In the current embodiment of the present invention, the pair of lateral panels 21 each comprise an axle mount, an upper panel mount 15, a base panel mount 17, upper channels 18, and lower channels 19. The axle mount is a structural feature that permits the pivotable and moveable engagement with the pair of axle members 10. The axle mount is found on each lateral panel 21 of the pair of lateral panels 21 near the rear panel 20 and the upper channels 18. The axle mount limits the movement of the pair of axle members 10 in order to ensure the secure attachment of the upper panel 7 to the pair of lateral panels 21. The upper panel mount 15 of the pair of lateral panels 21 are recessed regions of each lateral panel 21 that become coincident with the pair of lateral panel mounts 11. The upper panel mount 15 of the pair of lateral panels 21 functions primarily to retain the upper panel 7 in place in the closed configuration. The upper panel mount 15 of the pair of lateral panels 21 are found coplanar with the upper panel mount 15 of the front panel 14. The base panel mount 17 of the pair of lateral panels 21 function as the engagement with the base panel 13. The base panel mount of the pair of lateral panels 21 is found coplanar to the base panel mount 17 of the front panel 14 and the rear panel 20. The upper channels 18 of the pair of lateral panels 21 are found positioned adjacent to the upper panel mount 15 of the pair of lateral panels 21. The upper channels 18 function as a means of engaging the plurality of corner clips 2 which subsequently function as a means of engaging the upper channels 18 of the front panel 14 and the rear panel 20. The lower channels 19 are found positioned adjacent to the base panel 13 when coupled to the base panel mount 17 of the pair of lateral panels 21. The lower channels 19 function as a means of engaging the plurality of lower corner clips 2 which subsequently function as a means of coupling to the front panel 14 and the rear panel 20.

Referencing FIG. 1-4, the arrangement of the front panel 14, the rear panel 20, and the pair of lateral panels 21 allows for a particular alignment of the upper channels 18 and the lower channels 19. Specifically the upper channels 18 of the front panel 14 are found perpendicular to the upper channels 18 of the pair of lateral panels 21. Furthermore the upper channels 18 of the rear panel 20 are found perpendicular to the upper channels 18 of the pair of lateral panels 21. These arrangements permit a specific orientation with the plurality of corner clips 2 that are engaged to the upper channels 18. The lower channels 19 of the front panel 14 are found perpendicular to the lower channels 19 of the pair of lateral panels 21. The lower channels 19 of the rear panel 20 are found perpendicular to the lower channels 19 of the pair of lateral panels 21. through the specific arrangement of the lower channels 19, the plurality of corner clips 2 engaged to the lower channels 19 are able to securely engage the front panel 14, the rear panel 20, and the pair of lateral panels 21. It should be noted that the upper channels 18 of the front panel 14, the rear panel 20, and the pair of lateral panels 21 are found coplanar to one another. Furthermore it should be noted that the lower channels 19 of the front panel 14, the rear panel 20, and the pair of lateral panels 21 are found coplanar to one another. The set of upper channels 18 are found parallel to the set of lower channels 19 but in additional embodiments the lower channels 19 and the upper channels 18 could be staggered to accommodate differing components positioning while still retaining their functionality.

Referencing FIG. 6, FIG. 8, and FIG. 9, the base panel 13 functions as the floor for the enclosable storage compartment 1. The base panel 13 positioned opposite the upper panel 7. The base panel 13 is permitrically bordered by the front panel 14, the rear panel 20, and the pair of lateral panels 21. The front panel 14 and the rear panel 20 are positioned opposite across the base panel 13. The base panel 13 is found positioned between the pair of lateral panels 21. The base panel 13 is found positioned adjacent to the lower channels 19 of the front panel 14, the rear panel 20, and the pair of lateral panels 21. The base panel 13 is found perpendicularly secured to the front panel 14, the rear panel 20, and the pair of lateral panels 21 by way of the coplanar positioning of the base panel mounts 17. The engagement of the base panel 13 with the base panel mount 17 is accomplished through the use of specific tabs peripherally positioned on the base panel 13 that permit the base panel 13 to traverse the base panel mounts 17. In the current embodiment of the present invention, the base panel 13 comprises corner engagement. The corner engagements 12 of the base panel 13 are found positioned adjacent to the lower channels 19. The corner engagement of the base panel 13 function as a means of distributing weight applied to the base panel 13 to the plurality of corner clips 2 engaged to the lower channels 19. The corner engagements 12 accomplish this through a coincident engagement to the plurality of corner clips 2 engaged to the lower channels 19.

Figure 7:
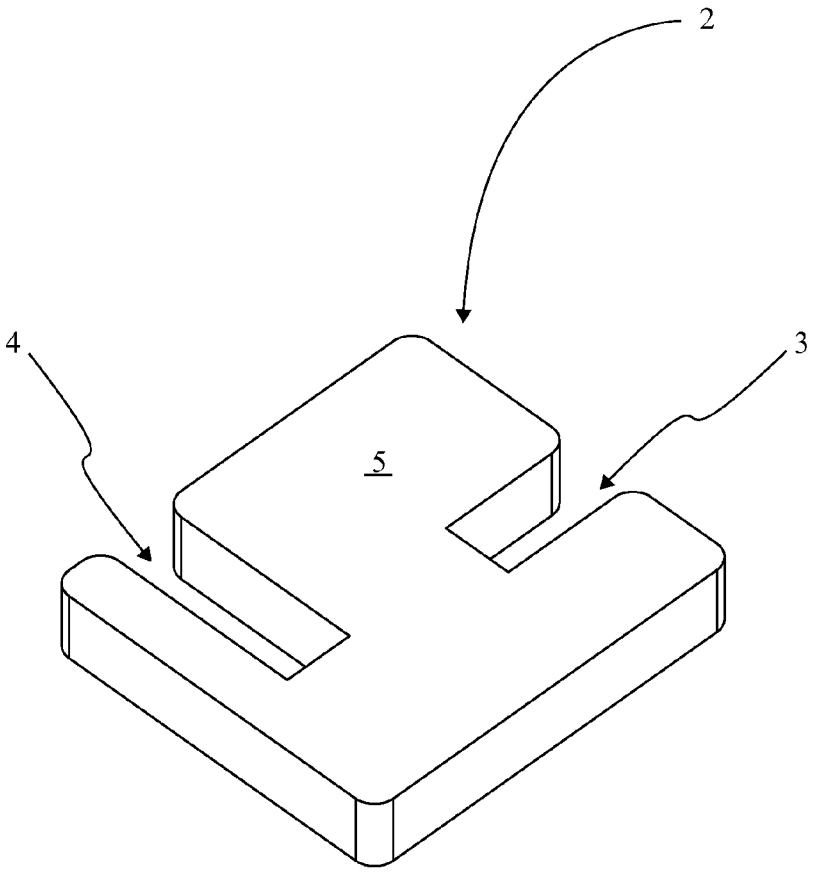
FIG. 7 is a perspective view displaying a corner clip of the plurality of corner clips as per the current embodiment of the present invention.

Referencing FIG. 7-9, the plurality of corner clips 2 are provided as the engagement means for securing the plurality of panel sections 6 together. The plurality of corner clips 2 engage the upper channels 18 of the front panel 14, the rear panel 20, and the pair of lateral panels 21. The plurality of corner clips 2 engage the lower channels 19 of the front panel 14, the rear panel 20, and the pair of lateral panels 21. The plurality of corner clips 2 engaged to the lower channels 19 function as a means to distribute and retain the positioning of the base panel 13. The plurality of corner clips 2 engaged to the upper channels 18 function as a means of retaining the upper panel 7 in place in the closed configuration. In the current embodiment of the present invention, each of the plurality of corner clips 2 comprise a first channel 3, a second channel 4, and a shelf region 5. The first channel 3 of the plurality of corner clips 2 is specifically provided as a means of engaging the upper channels 18 and lower channels 19 of the front panel 14 and the rear panel 20. The second channel 4 of the plurality of corner clips 2 is specifically provided as a means of engaging the upper and lower channels 19 of the pair of lateral panels 21. The shelf region 5 is provided between the first channel 3 and the second channel 4. Through the particular arrangement of the first channel 3 and the second channel 4, each of the plurality of corner clips 2 will be particularly oriented with the plurality of panel sections 6 in order to provide the shelf region 5 with a positioning that is coincident with the enclosable storage compartment 1. It should be noted that to ensure the tool-less nature of the plurality of corner clips 2, the first channel 3 and the second channel 4 are provided with a width that is at least 90% of the thickness of the plurality of panel sections 6. In order to provide the necessary thickness the plurality of corner clips 2 are laser cut component that are uniformly shaped.

The present invention is a knock down wood box system comprising a base panel 13, a pair of lateral panels 21, a rear panel 20, a front panel 14, an upper panel 7, and a plurality of corner clips 2. The plurality of panel sections 6 are shaped such that they fit together in a specific way in order to form a box. The bottom panel comprises the bottom of the box. The bottom panel is generally shaped as a flat, rectangular piece of material. The bottom panel further comprises a plurality of tabs which protrude out form the edges of the rectangle shape. The plurality of tabs serves as the interface between the bottom panel and the other components of the present invention. In the preferred embodiment of the present invention, all of the different components that comprise the box are made entirely out of wood. Wood is an ideal choice for the construction of the box as wood is both rigid and very aesthetically pleasing to most people. Additionally, there is a wide range of different species of wood and a wide range of different finishes that can be applied to that wood to provide different aesthetic looks in the material that is ultimately used in the construction of the present invention. Although wood is an ideal material to use in the construction of the components of the present invention, it is not the only material that could be used to fabricate the present invention. The present invention could potentially be made out of materials including but not limited to metal and plastic.

Connected to either side of the bottom panel is one of the pair of lateral panels 21. The pair of lateral panels 21 connect to the bottom panel on the short sides of the rectangular shape. The pair of lateral panels 21 connect via the plurality of tabs located along the edges of the bottom panel. Each lateral panel 21 of the pair of lateral panels 21 comprises a flat piece of material that is cut into the correct shape to form the lateral panel 21. The material used in the construction of each lateral panel 21 is most logically the same material that was used in the construction of the bottom panel. Each of the pair of lateral panels 21 further comprises four channels and two rectangular holes. The four channels are generally arranged at the four corners of each lateral panel 21. The channels are generally rectangular in shape with a width that is specifically related to the thickness of the material used in the construction of the present invention. The plurality of channels serve as the connection points between the pair of lateral panels 21 and the front panel 14 and rear panel 20 of the present invention. Each channel receives one of the plurality of corner clips 2, which in turn connect to the channel on other panels of the present invention. Returning to the topic of the width of each channel, it is vital that the width of the channel be slightly smaller than the thickness of the material used to construct the corner clip. This ensures that the corner clip will be held securely in position by friction between the channel and the corner clip.

The two holes, which are also located on each of the pair of lateral panels 21, allow additional interface between the components of the present invention. One of the two holes is located in the top right of the lateral panel 21. This positioning allows the upper panel 7 to interface with each of the pair of lateral panels 21. In this manner, the upper panel 7 can be opened and closed in a rotational manner without the use of any metal hinges. This is discussed in more detail when the upper panel 7 is further described. The other one of the two holes is located near the very bottom of each lateral panel 21. This hole is located just above the top edge of the two channels at the bottom of the lateral panel 21. This allows the corner clips 2, which are inserted into the channels, to offer additional support to the bottom panel when the present invention is assembled. The rectangular hole is shaped and sized such that it is only slightly smaller than one of the tabs that protrudes from the bottom panel, thus ensuring that friction between the bottom panel and the hole in the lateral panel 21 ensure they stay fitted together.

The rear panel 20 of the present invention is very similar in construction to the lateral panels 21, comprising the same four channels and a hole where the bottom panel is inserted into the back panel. The only major differences between the lateral panel 21 and the rear panel 20 lie in the shape, size, and the lack of a second rectangular hole in the rear panel 20.

The front panel 14 is also very similar in construction to the lateral panel 21. The front panel 14 is approximately the same size as the rear panel 20 and possessing the same four channels and rectangular hole which allow the front panel 14 to be connected to the other panels that comprise the present invention.

The upper panel 7 of the present invention has a generally rectangular shape. On the top corners of the upper panel 7 is located a very specifically shape protrusion. This protrusion interfaces with the rectangular hole in the top corner of each lateral panel 21. When connected to both lateral panels 21 in this way, the upper panel 7 is free to open and close in a rotational manner as a sort of hinge has been formed through the interface between the upper panel 7 and the pair of lateral panels 21. This protrusion in the top corners of the upper panel 7 rest not only on the rectangular hole in the lateral panel 21, but also on the corner clip, which provides additional support. A channel in the top corners is also cut into the upper panel 7 to facilitate this contact between the upper panel 7 and the corner clip.

The plurality of corner clips 2 are the components responsible for holding the pair of lateral panels 21, and the front panel 14 and rear panel 20 to one another. Each corner clip fits into two channels which are from perpendicular panels. For example, one corner clip may be connected to both one lateral panel 21 and the front panel 14 or connected to one lateral panel 21 and the rear panel 20. In the preferred embodiment of the present invention, there are eight corner clips 2, one for each corner of the box shape formed by the present invention. Each corner clip comprises a rectangular shelf region 5, which is complemented by two channels that are cut into perpendicular sides of the corner clip. Each channel is slightly smaller in width than the thickness of the material used in the construction of the panels. This ensures that the corner clips 2 are able to stay connected to the different panels of the present invention through friction between the channels of the corner clip and the surfaces of the panels.

Although the invention has been explained in relation to its preferred embodiment, it is to be understood that many other possible modifications and variations can be made without departing from the spirit and scope of the invention as hereinafter claimed.

What is claimed is:

1. A knock down wood box system comprises:

an enclosable storage compartment;

a plurality of corner clips;

a plurality of panel sections;

the plurality of panel sections comprise an upper panel, a base panel, a front panel, a rear panel, and a pair of lateral panels;

the plurality of corner clips each comprise a first channel, a second channel, and a shelf region;

the upper panel and the base panel each comprises corner engagements;

the upper panel comprises a front panel coupler, a pair of axle members, and a pair of lateral panel mounts;

the front panel, the rear panel, and the pair of lateral panels each comprise upper channels, lower channels, and a base panel mount;

the front panel and the pair of lateral panels each comprise an upper panel mount;

the pair of lateral panels each comprise an axle mount;

the front panel mount comprises a front panel coupler;

the upper panel mount of the front panel comprises a upper panel coupler;

the enclosable storage compartment being surrounded by the plurality of panel sections;

the front panel being coupled to the pair of lateral panels by way of the plurality of corner clips;

the rear panel being coupled to the pair of lateral panels, opposite the front panel, by way of the plurality of corner clips;

the upper panel being pivotably coupled to the pair of lateral panels;

the upper panel being positioned adjacent to the upper channels of the front panel, the rear panel, and the pair of lateral panels;

the pair of axle members being rotatably and movably positioned within the axle mount of each lateral panel of the pair of lateral panels;

each of the lateral panel mount of the pair of lateral panel mounts being pivotably coincident with a front panel mount;

the front panel mount being pivotably coincident with the upper panel mount of the front panel;

the front panel coupler being detachably coupled to the upper panel coupler;

the base panel being positioned adjacent to the lower channels of the front panel, the rear panel, and the pair of lateral panels; and the base panel being perpendicularly secured to the front panel, the rear panel, and the pair of lateral panels by way of the base panel mount.

2. The knock down wood box system as claimed in claim 1 comprises:

the upper channels of the front panel being perpendicular to the upper channels of the pair of lateral panels;

the upper channels of the rear panel being perpendicular to the upper channels of the pair of lateral panel;

the lower channels of the front panel being perpendicular to the lower channels of the pair of lateral panels;

the lower channels of the rear panel being perpendicular to the lower channels of the pair of lateral panel;

the corner engagements of the upper panel being detachably retained against the shelf regions of the plurality of corner clips coincident with the upper channels;

the corner engagements of the base panel being positioned adjacent to the lower channels; and the corner engagements of the base panel being retained against the shelf regions of the plurality of corner clips coincident with the lower channels.

3. The knock down wood box system as claimed in claim 1 comprises:

the first channel of the plurality of corner clips being coincident with the upper channels and the lower channels of the front panel and the rear panel; and the second channel of the plurality of corners clips being coincident with the upper channels and the lower channels of the pair of lateral panels.

4. The knock down wood box system in claim 1, wherein each panel section of the plurality of panel sections being of relatively equal thickness.

5. The knock down wood box system in claim 1, wherein the width of the upper channels, the lower channels, the first channel, and the second channel being at least 90% the thickness of the plurality of panel sections.

6. The knock down wood box system in claim 1, wherein the plurality of panel sections and the plurality of corner clips being constructed of wood.

7. A knock down wood box system comprises:

an enclosable storage compartment;

a plurality of corner clips;

a plurality of panel sections;

the plurality of panel sections comprise an upper panel, a base panel, a front panel, a rear panel, and a pair of lateral panels;

the plurality of corner clips each comprise a first channel, a second channel, and a shelf region;

the upper panel and the base panel each comprises corner engagements;

the upper panel comprises a front panel coupler, a pair of axle members, and a pair of lateral panel mounts;

the front panel, the rear panel, and the pair of lateral panels each comprise upper channels, lower channels, and a base panel mount;

the front panel and the pair of lateral panels each comprise an upper panel mount;

the pair of lateral panels each comprise an axle mount;

the front panel mount comprises a front panel coupler;

the upper panel mount of the front panel comprises a upper panel coupler;

the enclosable storage compartment being surrounded by the plurality of panel sections;

the front panel being coupled to the pair of lateral panels by way of the plurality of corner clips;

the rear panel being coupled to the pair of lateral panels, opposite the front panel, by way of the plurality of corner clips;

the upper panel being pivotably coupled to the pair of lateral panels;

the upper panel being positioned adjacent to the upper channels of the front panel, the rear panel, and the pair of lateral panels;

the pair of axle members being rotatably and movably positioned within the axle mount of each lateral panel of the pair of lateral panels;

each of the lateral panel mount of the pair of lateral panel mounts being pivotably coincident with a front panel mount;

the front panel mount being pivotably coincident with the upper panel mount of the front panel;

the front panel coupler being detachably coupled to the upper panel coupler;

the base panel being positioned adjacent to the lower channels of the front panel, the rear panel, and the pair of lateral panels;

the base panel being perpendicularly secured to the front panel, the rear panel, and the pair of lateral panels by way of the base panel mount;

the upper channels of the front panel being perpendicular to the upper channels of the pair of lateral panels;

the upper channels of the rear panel being perpendicular to the upper channels of the pair of lateral panel;

the lower channels of the front panel being perpendicular to the lower channels of the pair of lateral panels;

the lower channels of the rear panel being perpendicular to the lower channels of the pair of lateral panel;

the corner engagements of the upper panel being detachably retained against the shelf regions of the plurality of corner clips coincident with the upper channels;

the corner engagements of the base panel being positioned adjacent to the lower channels;

the corner engagements of the base panel being retained against the shelf regions of the plurality of corner clips coincident with the lower channels;

the first channel of the plurality of corner clips being coincident with the upper channels and the lower channels of the front panel and the rear panel; and the second channel of the plurality of corners clips being coincident with the upper channels and the lower channels of the pair of lateral panels.

8. The knock down wood box system in claim 7, wherein each panel section of the plurality of panel sections being of relatively equal thickness.

9. The knock down wood box system in claim 7, wherein the width of the upper channels, the lower channels, the first channel, and the second channel being at least 90% the thickness of the plurality of panel sections.

10. The knock down wood box system in claim 7, wherein the plurality of panel sections and the plurality of corner clips being constructed of wood.

11. A knock down wood box system comprises:

an enclosable storage compartment;

a plurality of corner clips;

a plurality of panel sections;

the plurality of panel sections comprise an upper panel, a base panel, a front panel, a rear panel, and a pair of lateral panels;

the plurality of corner clips each comprise a first channel, a second channel, and a shelf region;

the upper panel and the base panel each comprises corner engagements;

the upper panel comprises a front panel coupler, a pair of axle members, and a pair of lateral panel mounts;

the front panel, the rear panel, and the pair of lateral panels each comprise upper channels, lower channels, and a base panel mount;

the front panel and the pair of lateral panels each comprise an upper panel mount;

the pair of lateral panels each comprise an axle mount;

the front panel mount comprises a front panel coupler;

the upper panel mount of the front panel comprises a upper panel coupler;

the enclosable storage compartment being surrounded by the plurality of panel sections;

the front panel being coupled to the pair of lateral panels by way of the plurality of corner clips;

the rear panel being coupled to the pair of lateral panels, opposite the front panel, by way of the plurality of corner clips;

the upper panel being pivotably coupled to the pair of lateral panels;

the upper panel being positioned adjacent to the upper channels of the front panel, the rear panel, and the pair of lateral panels;

the pair of axle members being rotatably and movably positioned within the axle mount of each lateral panel of the pair of lateral panels;

each of the lateral panel mount of the pair of lateral panel mounts being pivotably coincident with a front panel mount;

the front panel mount being pivotably coincident with the upper panel mount of the front panel;

the front panel coupler being detachably coupled to the upper panel coupler;

the base panel being positioned adjacent to the lower channels of the front panel, the rear panel, and the pair of lateral panels;

the base panel being perpendicularly secured to the front panel, the rear panel, and the pair of lateral panels by way of the base panel mount;

the upper channels of the front panel being perpendicular to the upper channels of the pair of lateral panels;

the upper channels of the rear panel being perpendicular to the upper channels of the pair of lateral panel;

the lower channels of the front panel being perpendicular to the lower channels of the pair of lateral panels;

the lower channels of the rear panel being perpendicular to the lower channels of the pair of lateral panel;

the corner engagements of the upper panel being detachably retained against the shelf regions of the plurality of corner clips coincident with the upper channels;

the corner engagements of the base panel being positioned adjacent to the lower channels;

the corner engagements of the base panel being retained against the shelf regions of the plurality of corner clips coincident with the lower channels;

the first channel of the plurality of corner clips being coincident with the upper channels and the lower channels of the front panel and the rear panel;

the second channel of the plurality of corners clips being coincident with the upper channels and the lower channels of the pair of lateral panels;

each panel section of the plurality of panel sections being of relatively equal thickness;

the width of the upper channels, the lower channels, the first channel, and the second channel being at least 90% the thickness of the plurality of panel sections; and the plurality of panel sections and the plurality of corner clips being constructed of wood.

* * * * *